US009854916B2

(12) United States Patent
Murphy

(10) Patent No.: US 9,854,916 B2
(45) Date of Patent: Jan. 2, 2018

(54) SEATING UNIT CONVERTIBLE TO BED

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 15/477,581

(22) Filed: Apr. 3, 2017

(65) Prior Publication Data

US 2017/0202359 A1 Jul. 20, 2017

Related U.S. Application Data

(63) Continuation-in-part of application No. 14/539,235, filed on Nov. 12, 2014, now Pat. No. 9,622,587.
(Continued)

(51) Int. Cl.
*A47C 17/04* (2006.01)
*A47C 17/165* (2006.01)
(Continued)

(52) U.S. Cl.
CPC ..... *A47C 17/165* (2013.01); *A47C 7/402* (2013.01); *A47C 17/207* (2013.01); *A47C 17/2073* (2013.01); *A47C 17/2076* (2013.01)

(58) Field of Classification Search
CPC ..... A47C 17/04
(Continued)

(56) References Cited

U.S. PATENT DOCUMENTS 507,270 A 10/1893 Hirschfeld
2,328,411 A 8/1943 Bergstrom
(Continued)

FOREIGN PATENT DOCUMENTS

EP 0504129 9/1992
EP 1946678 7/2008
WO WO2005/089594 9/2005

OTHER PUBLICATIONS

International Search Report and Written Opinion for corresponding PCT Application No. PCT/US15/46555, dated Jan. 12, 2016, 19 pages.
(Continued)

*Primary Examiner* — Fredrick Conley
(74) *Attorney, Agent, or Firm* — Myers Bigel, P.A.

(57) ABSTRACT

A foldable sofa-bed includes: a base with an internal cavity and a rear member; a foldable bed that includes separate and distinct head, intermediate and seat sections, each with a respective cushion, wherein in a folded position, the intermediate and seat sections are generally horizontally disposed and positioned in vertically stacked relationship, with the intermediate and seat cushions facing generally upwardly, and the head section is generally vertically disposed and positioned adjacent the rear wall of the base, and in an unfolded position, the head, intermediate and seat sections are generally horizontally disposed in serial alignment; and a bed folding mechanism that is attached to the base and the head, intermediate and seat sections that controls the movement of the bed between the folded and unfolded positions. In moving from the folded to the unfolded position, the intermediate section maintains generally the same orientation.

12 Claims, 4 Drawing Sheets

Related U.S. Application Data

(60) Provisional application No. 62/041,264, filed on Aug. 25, 2014.

(51) Int. Cl.
*A47C 17/207* (2006.01)
*A47C 7/40* (2006.01)

(58) Field of Classification Search
USPC ..... 5/12–13, 17, 18.1, 37.1, 41
See application file for complete search history.

(56) References Cited

U.S. PATENT DOCUMENTS

| | | | | |
|---|---|---|---|---|
| 2,740,131 | A | 4/1956 | Vogel et al. | |
| 3,002,198 | A | 10/1961 | Kaiser et al. | |
| 4,200,941 | A | 5/1980 | Gill et al. | |
| 4,672,696 | A | 6/1987 | Horenkamp | |
| 5,195,194 | A | 3/1993 | Bradley et al. | |
| 5,904,401 | A | 5/1999 | Alberda et al. | |
| 7,547,182 | B2 | 6/2009 | Hogue et al. | |
| 8,438,676 | B2 | 5/2013 | Murphy | |
| 2005/0052067 | A1 | 3/2005 | Grimm et al. | |
| 2006/0000022 | A1 | 1/2006 | Dewert et al. | |
| 2007/0151023 | A1* | 7/2007 | Murphy ..... | A47C 17/17 5/13 |
| 2007/0283491 | A1* | 12/2007 | Murphy ..... | A47C 17/20 5/13 |

OTHER PUBLICATIONS

International Search Report and Written Opinion for corresponding PCT Application No. PCT/US15/46555, dated Sep. 8, 2016, 6 pages.

* cited by examiner

SEATING UNIT CONVERTIBLE TO BED

RELATED APPLICATION

The present application claims the benefit of and priority from U.S. patent application Ser. No. 14/539,235, filed Nov. 12, 2014, and U.S. Provisional Patent Application No. 62/041,264, filed Aug. 25, 2014, the disclosure of which is hereby incorporated herein in its entirety.

FIELD OF THE INVENTION

The present invention relates generally to furniture, and more specifically a furniture unit that is convertible into a bed.

BACKGROUND OF THE INVENTION

Furniture units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other furniture units lack a complete mattress, but instead are constructed of separate sections that serve as support surfaces of the sofa and unfold to form a flat, mattress-like sleeping surface. Different examples of this basic concept are shown in U.S. Pat. No. 2,740,131 to Vogel et al., U.S. Pat. No. 5,195,194 to Bradley, U.S. Pat. No. 7,547,182 to Murphy, U.S. Pat. No. 8,438,676 to Murphy, and International Patent Application Serial No. PCT/US2014/038908, the disclosure of each of which is hereby incorporated herein in its entirety. The bed shown in U.S. Pat. No. 8,438,676 to Murphy includes three separate sections that serve as the mattress of the bed: a seat section; an intermediate section; and a head section. A folding mechanism controls the movement of the head, intermediate and seat sections between a folded position, in which the head, intermediate and seat sections are positioned in a vertically stacked relationship, with the head section below the intermediate section and the seat section above the intermediate section, and with the head and intermediate sections being positioned in the cavity of the housing and the seat section serving as the "seat" for the sofa, and an unfolded position, in which the head, intermediate and seat sections are horizontally disposed and serially aligned to form a sleeping surface.

In spite of the existence of these different foldable beds, it may be desirable to offer additional furniture units that can house foldable beds.

SUMMARY OF THE INVENTION

As a first aspect, embodiments of the invention are directed to a foldable sofa-bed, comprising: a base with an internal cavity and a rear member, the base configured to rest on an underlying surface; a foldable bed that includes separate and distinct head, intermediate and seat sections, each with a respective cushion, wherein in a folded position, the intermediate and seat sections are generally horizontally disposed and positioned in vertically stacked relationship, with the intermediate and seat cushions facing generally upwardly, and the head section is generally vertically disposed and positioned adjacent the rear wall of the base, and in an unfolded position, the head, intermediate and seat sections are generally horizontally disposed and in serial alignment with each other; and a bed folding mechanism that is attached to the base and the head, intermediate and seat sections that controls the movement of the bed between the folded and unfolded positions. In moving from the folded to the unfolded position, the intermediate section maintains generally the same orientation.

As a second aspect, embodiments of the invention are directed to a foldable sofa-bed, comprising: a base with an internal cavity and a rear wall, the base configured to rest on an underlying surface; a foldable bed that includes separate and distinct head, intermediate and seat sections, each with a respective cushion, wherein in a folded position, the intermediate and seat sections are generally horizontally disposed and positioned in vertically stacked relationship, with the intermediate and seat cushions facing generally upwardly, and the head section is generally vertically disposed and positioned adjacent the rear wall of the base, and in an unfolded position, the head, intermediate and seat sections are generally horizontally disposed and in serial alignment with each other; and a bed folding mechanism that is attached to the base and the head, intermediate and seat sections that controls the movement of the bed between the folded and unfolded positions. In moving from the folded to the unfolded position, the intermediate section maintains generally the same orientation. The seat section is supported by at least one wheel that rolls on the underlying surface; and the intermediate section is supported by at least one wheel that rolls on the underlying surface.

As a third aspect, embodiments of the invention are directed to a foldable sofa-bed, comprising: a base with an internal cavity and a rear member, the base configured to rest on an underlying surface; a foldable bed that includes separate and distinct head, intermediate and seat sections, each with a respective cushion, wherein in a folded position, the intermediate and seat sections are generally horizontally disposed and positioned in vertically stacked relationship, with the intermediate and seat cushions facing generally upwardly, and the head section is generally vertically disposed and positioned adjacent the rear wall of the base, and in an unfolded position, the head, intermediate and seat sections are generally horizontally disposed and in serial alignment with each other; a bed folding mechanism that is attached to the base and the head, intermediate and seat sections that controls the movement of the bed between the folded and unfolded positions; and a linear power actuator to move the bed between the folded and unfolded positions. In the unfolded position the seat, intermediate and head cushions form a king-sized bed.

As a fourth aspect, embodiments of the invention are directed to a foldable sofa-bed, comprising: a base with an internal cavity and a rear member, the base configured to rest on an underlying surface; a foldable bed that includes head, intermediate and seat sections, the intermediate and seat sections being separate and distinct, each with a respective cushion, wherein in a folded position, the intermediate and seat sections are generally horizontally disposed and positioned in vertically stacked relationship, with the intermediate and seat cushions facing generally upwardly, and the head section is generally vertically disposed and positioned adjacent the rear wall of the base, and in an unfolded position, the head, intermediate and seat sections are generally horizontally disposed and in serial alignment with each other; and a bed folding mechanism that is attached to the base and the head, intermediate and seat sections that controls the movement of the bed between the folded and unfolded positions. In moving from the folded to the unfolded position, the intermediate section maintains generally the same orientation.

DETAILED DESCRIPTION OF EMBODIMENTS OF THE INVENTION

Figure 1:
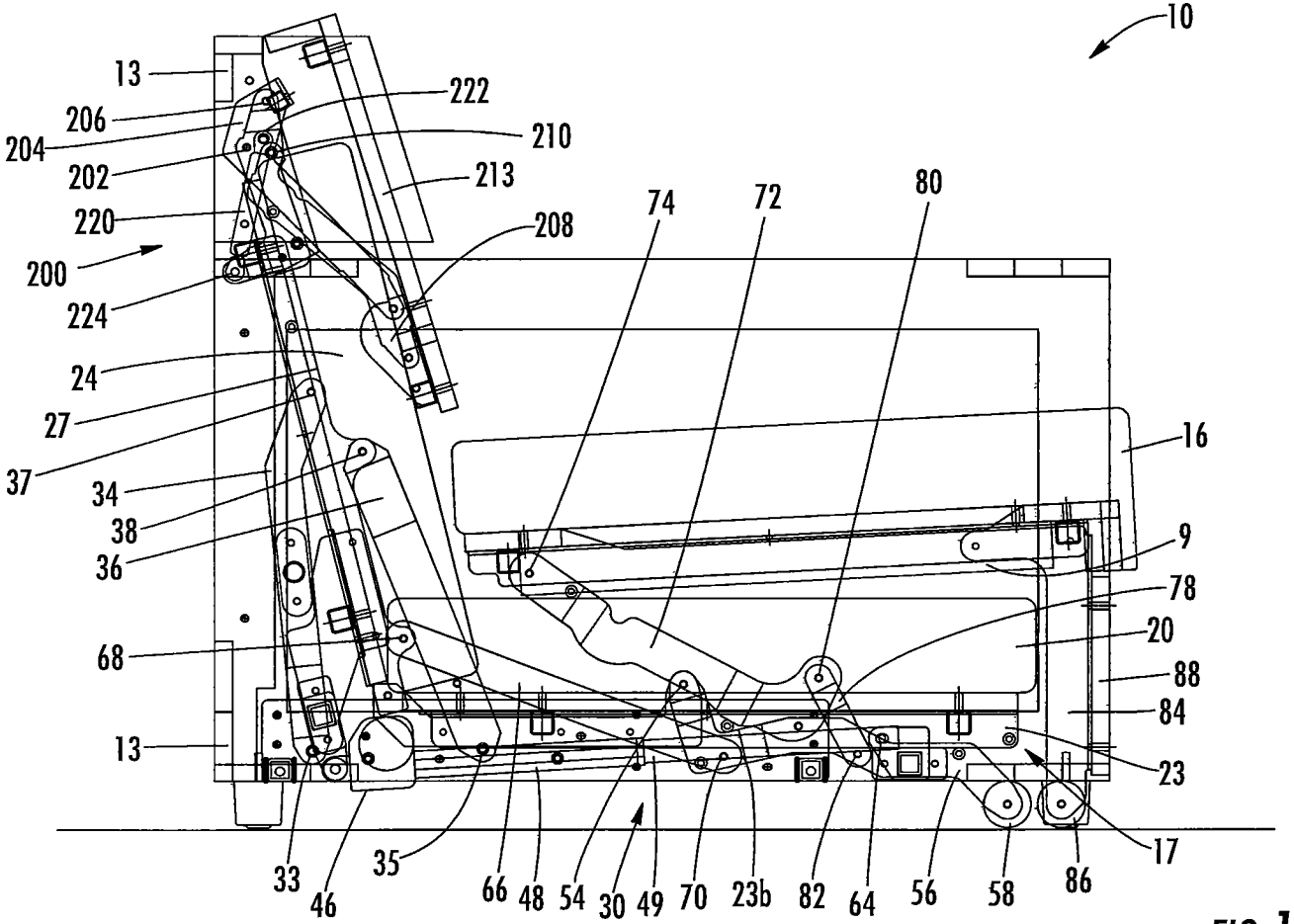
FIG. 1 is a side view of a foldable sofa-bed according to embodiments of the invention, with the bed in a folded position and the backrest in a lowered position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Referring now to the figures, a foldable sofa-bed, designated broadly at 10, is illustrated in FIGS. 1-4. The sofa-bed 10 includes a frame 11 having rear rails 13 that span arms 14, with the rails 13 and the arms 14 forming a storage cavity 17. A foldable bed 15 includes a seat section 16 with an underlying seat frame 18, an intermediate section 20 with an underlying intermediate panel 22, and a head section 24 with an underlying head panel 26. Each of the separate and distinct seat, intermediate and head sections 16, 20, 24 includes a respective cushion 19, 21, 25 (although in some embodiments the head and seat sections may share a common cushion). The intermediate and head panels 22, 26 are planar panels, typically formed of wood, that underlie most or all of cushions 21, 25 that provide a comfortable surface for sleeping. The seat frame 18 comprises three open square subframes that underlie the cushion 19 and that are described in some detail in co-assigned and co-pending U.S. patent application Ser. No. 13/900,311, filed on May 22, 2013, the disclosure of which is hereby incorporated herein in its entirety.

The bed 15 is movable (controlled by folding mechanisms 30—see below) between an unfolded position, in which the seat, intermediate and head sections 16, 20, 24 are horizontally disposed and serially aligned to form a sleeping surface with the cushions 19, 21, 25 (see FIGS. 3 and 4), and a folded position, in which the seat and sections 16, 20 are generally horizontally disposed and positioned in vertically stacked relationship in the cavity 17 of the frame 11, with the seat section 16 above the intermediate section 20, the cushions 19, 21 facing upwardly, and the head section 24 in a generally upright position adjacent the rear wall 13 with the cushion 25 facing generally forward (see FIGS. 1 and 2).

The movement of the sections 16, 20, 24 of the bed 15 is controlled by the aforementioned pair of folding mechanisms 30, which will be described in greater detail below. The folding mechanisms 30 are mirror images of each other about a vertical plane P (FIG. 4) that bisects the seating unit 10 normal to the rear rails 13; as such, only one bed folding mechanism 30 will be described herein, with the understanding that the description is applicable to the other mechanism also.

For the sake of clarity, the bed 15 will be described initially in the unfolded position of FIGS. 3 and 4; movement to the folded position of FIGS. 1 and 2 will then follow. As used herein to describe the relative positions of components, the terms "lateral", "outward" and derivatives thereof indicate the directions defined by a vector beginning at the vertical plane P that bisects the seating unit 10 normal to the rear rails 13 and extending toward either side wall 14. Conversely, the terms "inward", "inboard" and derivatives thereof indicate the direction opposite the "outward" direction. Together, the "inward" and "outward" directions comprise the "transverse" axis of the seating unit 10. The "rear" of the unfolded bed 15 is located at the end of the bed 15 nearest the rear rails 13 (i.e., toward the head section 24), and the "front" of the bed 15 is located at the end nearest the unfolded seat section 16. The "front" and "rear" directions comprise the "longitudinal" axis of the bed 15.

In addition, some components of the folding mechanisms 30 are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 3:
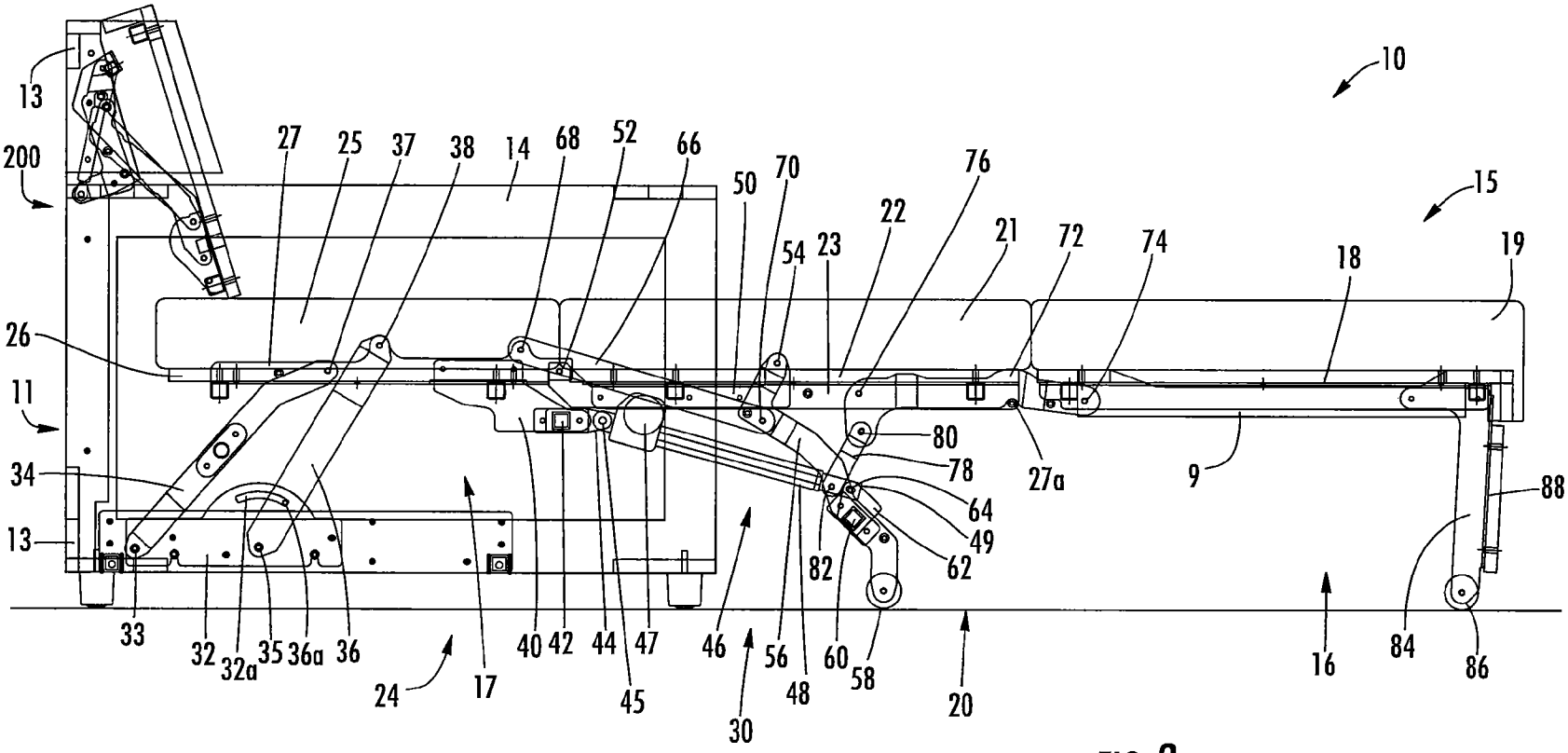
FIG. 3 is a side view of the sofa-bed of FIG. 1, with the bed in the unfolded position.

Turning now to FIG. 3, a mounting bracket 32 is mounted to the inner surface of the arm 14 and extends generally longitudinally. The mounting bracket 32 has an arcuate slot 32*a*. A rear swing link 34 is attached to the rear end of the mounting bracket 32 at a pivot 33 and extends upwardly and forwardly therefrom. A front swing link 36 is mounted to the mounting bracket 32 forwardly of the pivot 33 at a pivot 35. A pin 36*a* on the front swing link 36 is received in the slot 32*a*. The rear and front swing links 34, 36 are mounted at respective pivots 37, 38 to a bracket 27 that is fixed to the lateral edge of the head panel 26. The swing links 34, 36 control the movement of the head section 24 as it moves between the folded and unfolded positions.

Still referring to FIG. 3, the folding mechanism 30 includes an actuator mounting bracket 40 that is mounted to and depends from the bracket 27. A cross-member 42 spans the mounting brackets 40 on opposite sides of the bed 15. An actuator mounting flange 44 extends forwardly from the cross-member 42. A linear actuator 46 comprising a motor 47, a sleeve 48 and a rod 49 is mounted to the actuator mounting flange 44 at a pivot 45. The actuator 46 may be of any configuration suitable for inducing linear motion and need not be described in detail herein. Typically, the actuator 46 is operated via a push button, toggle switch or the like that is located remotely from the actuator motor 47; in one embodiment, the switch is located underneath the backrest plate 213 (see below) to prevent unfolding of the bed 15 until the backrest assembly 200 has moved the backrest cushion 214 out of the way.

A bracket 23 is mounted to and underlies the lateral edge of the intermediate panel 22. An extension 50 is fixed to the bracket 23. At its rear end, the extension 50 is hinged to the bracket 27 at a pivot 52. At its opposite end, the extension 50 is attached at a pivot 54 to the upper end of a center leg 56. A wheel 58 is attached at the lower end of the center leg 56. A cross-member 60 spans the center legs 56 on either side of the bed 50. A flange 62 is fixed to the cross-member 60. The forward end of the rod 49 of the actuator 46 is attached to the flange 62 at a pivot 64. A driving link 66 is attached near the forward end of the bracket 27 at a pivot 68. The driving link 66 is also attached near the upper end of the center leg 56 at a pivot 70.

Still referring to FIG. 3, a bracket 9 underlies the seat section 16. A transition link 72 is attached at its forward end to the bracket 9 at a pivot 74. The transition link 72 is also attached to a generally central portion of the bracket 23 at a pivot 76. An extension of the transition link 72 extends downwardly from the pivot 76. A connecting link 78 extends from a pivot 80 with the extension of the transition link 72 and a pivot 82 with the center leg 56. The transition link 72 also rests on a pin 27*a* located on the bracket 27 near its forward end to help to maintain the relationship of the seat and intermediate sections 16, 20. A forward leg 84 is fixed to the forward end of the bracket 9. A wheel 86 is mounted to the lower end of the forward leg 84. A front panel 88 spans the forward legs 84 on either side of the bed 15.

The seating unit 10 also includes a backrest cushion assembly 200, which can be seen in its lowered position in FIGS. 1 and 3. The backrest cushion assembly 200 includes a mounting bracket 202 fixed to the side panels of the arms 14. Upper and lower swing links 204, 208 are attached to the mounting bracket 202 at, respectively, pivots 206, 210. A mounting bracket 212 is attached to the upper and lower swing links 204, 208 at pivots 216, 218. A backrest plate 213 (on which is mounted one or more backrest cushions 214) is fixed to the mounting bracket 212. A gas cylinder 220 is attached to the upper swing link 204 at a pivot 222 and to the mounting bracket 202 at a pivot 224.

Figure 2:
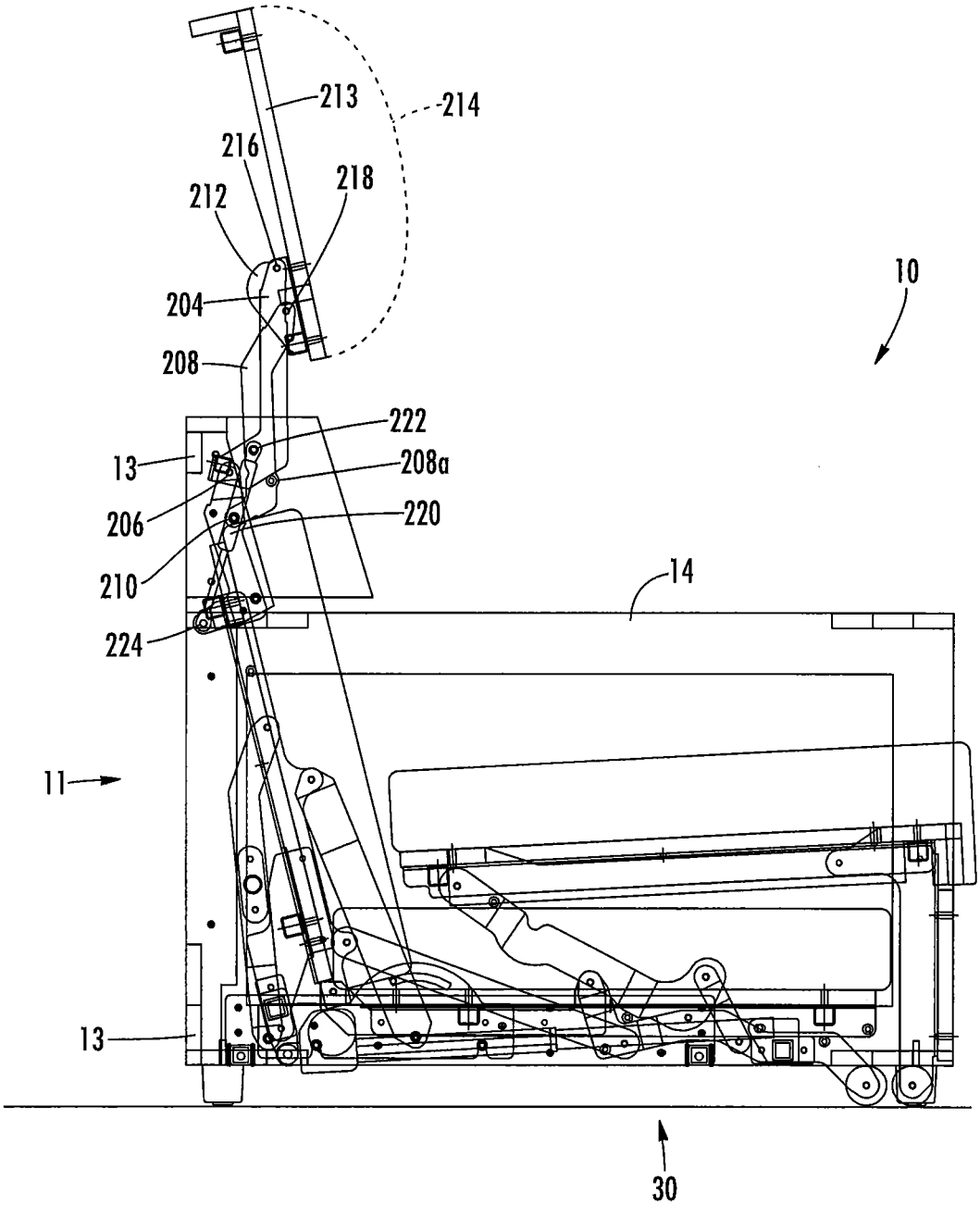
FIG. 2 is a side view of the sofa-bed of FIG. 1, with the bed in the folded position and the backrest in a raised position.
Figure 4:
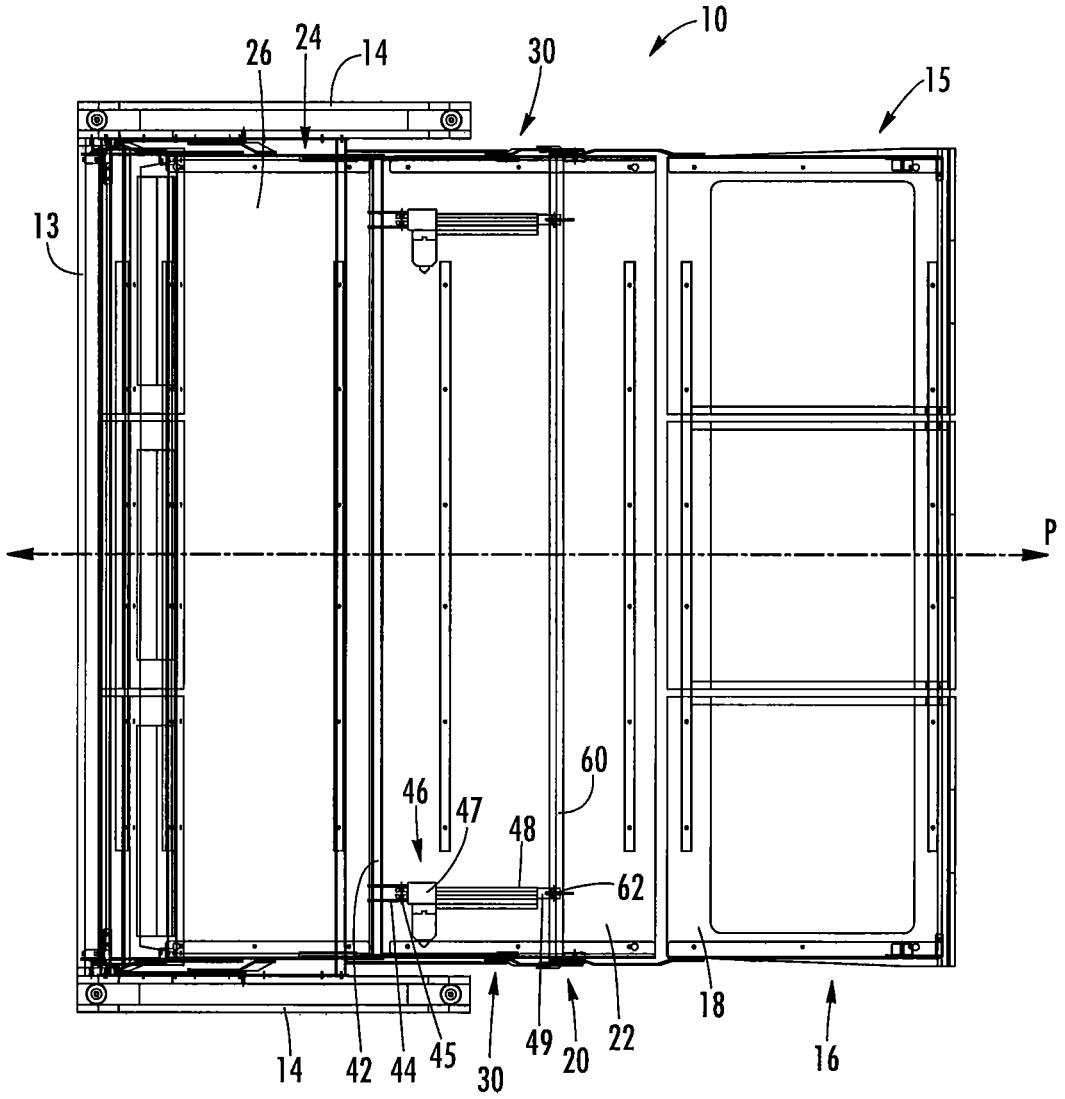
FIG. 4 is a top view of the sofa-bed of FIG. 1.

To move the bed 15 from the unfolded position of FIGS. 3 and 4 to the folded position of FIGS. 1 and 2, the linear actuator 46 is actuated, typically via a power switch (e.g., a toggle switch or the like) that is connected with the motor 47. In the unfolded position, the rod 49 is retracted into the sleeve 48; thus, actuation when the bed 15 is in the unfolded position begins to extend the rod 49 from the sleeve 48. As the rod 49 extends, it forces the flange 44, the cross-member 42, and the actuator mounting bracket 40 rearwardly. This action forces the head section 24 rearwardly and causes it to rotate (clockwise from the vantage point of FIGS. 1-3) about the pivot 52; the rotation is controlled by the rear and front swing links 34, 36 as they pivot counterclockwise about the pivots 33, 35. Also, the rotation of the head section 24 and the rearward movement of the actuator mounting bracket 40 (and, in turn, the actuator 46) induces the center leg 56 to pivot counterclockwise about the pivot 54, which draws the driving link 66 forwardly relative to the intermediate section 20, further encouraging the head section 24 to rotate about the pivot 52. The rearward and pivotal movement of the head section 24 draws the intermediate section 20 rearwardly and draws the rear end of the intermediate section 20 downwardly. As the intermediate section 20 descends, the center leg 56 continues to pivot counterclockwise about the pivot 54 to fold under the intermediate section 20. The wheel 58 remains on the underlying surface and aids in the rearward movement of the intermediate section 20. Rotation of the head section 24 ceases when the pin 36*a* reaches the rearward end of the slot 32*a*. The intermediate section 20 maintains generally the same orientation in both the folded and unfolded positions.

It should be noted that, in the illustrated embodiment, the front of the head section cushion 25 and the rear edge of the intermediate section cushion 21 are compressed and/or crushed into each other in the folded position. In some embodiments, such compression may be avoided.

As the center leg 56 rotates relative to the bracket 23, the connecting link 78 forces the lower end of the transition link 72 upwardly and forwardly, thereby rotating the transition link 72 counterclockwise about the pivot 76. Rotation of the transition link 72 draws the seat section 16 rearwardly; initially, the rear end of the seat section 16 rises, but eventually the rear end of the seat section 16 descends such that it is lower than the forward end of the seat section 16. During its rearward travel the seat section 16 is supported by the wheel 86, which rolls on the underlying surface. Rotation of the transition link 72 ceases when the transition link 72 contacts a pin 23*b* located near the center of the bracket 23.

In the illustrated embodiment, in the folded position, the front panel 88 is substantially upright and serves as the front panel of the sofa-bed 10. The seat section 16 typically slopes upwardly from back to front (typically at a pitch angle of between about 0 and 6 degrees) to provide a comfortable seating surface.

It should also be noted that, in FIGS. 1-3 that illustrate the folding and unfolding of the bed 15, the backrest cushion assembly 200 is in a lowered position in FIGS. 1 and 3 and a raised position in FIG. 2. In the lowered position, the gas cylinder 220 is in a retracted position and biases the upper swing link 204 upwardly. As such, it maintains an "over-center" condition between pivots 206, 222 and 224, which maintains the backrest cushion assembly 200 in the lowered position. The assembly 200 typically remains in this position for much of the time the seating unit 10 is in use, only being raised when the bed 15 is to be unfolded.

As can be seen in FIGS. 1 and 3, the backrest cushion 214 can be raised by applying a upward force to the backrest cushion 214 and/or backrest plate 213, which causes the upper and lower swing links 204, 208 to rotate counter-clockwise about the pivots 206, 210. Once the upper and lower swing links 204, 208 have rotated through the above-described "on-center" condition (shortly after the links 204, 208 begin to rotate), the gas cylinder 220 biases the backrest cushion assembly 200 toward the raised position shown in FIGS. 1 and 3. The assembly 200 ceases movement when a pin 208*a* on the lower swing link 208 contacts the lower edge of the upper swing link 204.

It should also be understood that, in some embodiments, the backrest cushion assembly 200 may be omitted, and may be replaced by loose cushions or the like.

The bed 15 can be moved from the folded position of FIGS. 1 and 2 to the unfolded position of FIG. 3 by reversing the direction of the motor 47 of the actuator 46, such that the rod 49 extends from the sleeve 48. Such retraction draws the center leg 56 clockwise around the pivot 54, which raises the intermediate section 20 and forces it forwardly. The remaining links reverse the direction of travel they follow during folding to move the bed 15 to the unfolded position of FIG. 3. Movement ceases when the pin 36 on the front swing link 34 reaches the forward end of the slot 32*a*.

The illustrated embodiment is sized for use with a "king-sized" sofa-bed (i.e., a bed that has a width of between about 74 and 80 inches, typically 76 inches, in the transverse direction), and is suitable for same. However, in other embodiments the mechanisms shown and described herein may be employed with queen-sized, standard-sized, and twin-sized sofa-beds.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A foldable sofa-bed, comprising:

a base with an internal cavity and a rear member, the base configured to rest on an underlying surface;

a foldable bed that includes separate and distinct head, intermediate and seat sections, each with a respective cushion, wherein in a folded position, the intermediate and seat sections are generally horizontally disposed and positioned in vertically stacked relationship, with the intermediate and seat cushions facing generally upwardly, and the head section is generally vertically disposed and positioned adjacent the rear member of the base, and in an unfolded position, the head, intermediate and seat sections are generally horizontally disposed and in serial alignment with each other; and a bed folding mechanism that is attached to the base and the head, intermediate and seat sections that controls the movement of the bed between the folded and unfolded positions;

wherein the cushion of the head section faces generally forwardly in the folded position; and further comprising a backrest cushion assembly attached to the base that moves a backrest cushion between lowered and raised positions.

2. The foldable sofa-bed defined in claim 1, wherein the seat section is supported by at least one wheel that rolls on the underlying surface.

3. The foldable sofa-bed defined in claim 2, wherein the bed folding mechanism includes a leg mounted to the seat section and to the wheel.

4. The foldable sofa-bed defined in claim 3, further comprises a front panel mounted to the leg, the front panel positioned below a front portion of the seat section.

5. The foldable sofa-bed defined in claim 1, wherein the intermediate section is supported by at least one wheel that rolls on the underlying surface.

6. The foldable sofa-bed defined in claim 1, wherein the bed folding mechanism further comprises a center leg mounted to the intermediate section and to the wheel, the center leg folding under the intermediate section in the folded position.

7. The foldable sofa-bed defined in claim 1, wherein the bed folding mechanism further includes a linear power actuator to move the bed between the folded and unfolded positions.

8. The foldable sofa-bed defined in claim 1, wherein the head, intermediate and seat sections are sized to form a king-sized bed.

9. A foldable sofa-bed, comprising:

a base with an internal cavity and a rear member, the base configured to rest on an underlying surface;

a foldable bed that includes separate and distinct head, intermediate and seat sections, each with a respective cushion, wherein in a folded position, the intermediate and seat sections are generally horizontally disposed and positioned in vertically stacked relationship, with the intermediate and seat cushions facing generally upwardly, and the head section is generally vertically disposed and positioned adjacent the rear member of the base, and in an unfolded position, the head, intermediate and seat sections are generally horizontally disposed and in serial alignment with each other;

a bed folding mechanism that is attached to the base and the head, intermediate and seat sections that controls the movement of the bed between the folded and unfolded positions; and a linear power actuator to move the bed between the folded and unfolded positions, the linear actuator positioned beneath the intermediate section in the folded and unfolded positions.

10. The foldable sofa-bed defined in claim 9, further comprising a backrest cushion assembly attached to the base that moves a backrest cushion between lowered and raised positions.

11. The foldable sofa-bed defined in claim 9, wherein the seat section is supported by at least one wheel that rolls on the underlying surface; and wherein the intermediate section is supported by at least one wheel that rolls on the underlying surface.

12. The foldable sofa-bed defined in claim 9, wherein the head, intermediate and seat sections are sized to form a king-sized bed.

* * * * *